US005605399A

United States Patent [19]

King

[11] Patent Number: 5,605,399

[45] Date of Patent: Feb. 25, 1997

[54] PROGRESSIVE MOTIONLESS MIXER

[75] Inventor: Leonard T. King, Long Beach, Calif.

[73] Assignee: Komax Systems, Inc., Wilmington, Calif.

[21] Appl. No.: 544,325

[22] Filed: Oct. 17, 1995

[51] Int. Cl.[6] ..... B01F 5/06

[52] U.S. Cl. ..... 366/337

[58] Field of Search ..... 366/181.5, 336–340; 138/37, 40, 42; 48/189.4

[56] References Cited

U.S. PATENT DOCUMENTS

| | | | |
|---|---|---|---|
| 2,567,998 | 9/1951 | Griffith | 138/42 |
| 3,545,492 | 12/1970 | Scheid, Jr. | 138/42 |
| 3,871,624 | 3/1975 | Huber et al. | 366/336 |
| 3,918,688 | 11/1975 | Huber et al. | 366/336 |
| 3,923,288 | 12/1975 | King | 366/336 |
| 4,614,440 | 9/1986 | King | 366/336 |
| 5,484,203 | 1/1996 | King et al. | 366/337 |

FOREIGN PATENT DOCUMENTS

| | | | |
|---|---|---|---|
| 58-133822 | 8/1983 | Japan | 366/336 |
| 58-133824 | 8/1983 | Japan | 366/336 |

*Primary Examiner*—Charles E. Cooley
*Attorney, Agent, or Firm*—Malcolm B. Wittenberg

[57] ABSTRACT

A stationary material mixing apparatus for the mixing of a fluid stream. A conduit is provided containing a number of mixing stations located along the longitudinal axis of the conduit, each occupying the entire cross-section of the conduit. The array of mixing elements of each mixing station is related to mixing elements at other mixing stations in that mixing elements at downstream mixing stations are of a smaller dimension than mixing elements at upstream mixing stations so that more mixing elements are contained within each mixing station as mixing stations approach the downstream end of the conduit.

10 Claims, 6 Drawing Sheets

PROGRESSIVE MOTIONLESS MIXER

TECHNICAL FIELD OF INVENTION

The present invention deals with a material mixing apparatus which contains various arrays of mixing elements which are related to one another in order to maximize the mixing of fluid streams passing within the stationary material mixing apparatus. In judiciously arranging the various motionless mixing elements pursuant to the present invention, enhanced mixing can be achieved over comparable devices of the prior art.

BACKGROUND OF THE INVENTION

It has long been realized that motionless mixers if made to work efficiently, provide certain economic advantages over dynamic mixers for, as the name implies, motionless mixers employ no moving parts. As such, motionless devices are generally less expensive to configure and certainly much less expensive to maintain while providing the user with an extended useful life for the mixer product in service.

Prior art approaches to motionless mixers have generally involved expensive machining, molding, casting or other fabrication of the component mixer elements coupled with some type of permanent attachment between elements and a conduit and/or between elements within a conduit. The resulting cost and difficulty of manufacture results in a relatively expensive end product. Moreover, many of the prior mixers provide less than complete mixing particularly with respect to material flowing along the walls of the conduit. This so-called "wall-smearing" is related to the parabolic velocity profile of a fluid having laminar flow in a pipe where the fluid velocity is small or zero along the wall surfaces.

Despite their limitations, static or motionless mixers are in common use in many industrial fields and are applied to both laminar and turbulent flow applications. A wide variety of mixing element designs is available from different manufacturers. Mixing elements are installed in a tube or pipe conduit in series and are fixed in position relative to the conduit wall. The cross-section is usually round but can be square or even rectangular. Materials introduced to the inlet or upstream side of the conduit on a continuous flow basis emerge mixed.

The number of mixing elements required to complete a given mixing task can range from two to twenty or more depending on the difficulty of the mixing application. In general, more mixing elements are required to solve laminar flow mixing problems than are needed in turbulent flow situations. One of the most difficult laminar flow mixing problems, for example, is to mix a small quantity of a low viscosity additive into a much higher viscosity main product flow. Mixing involves the application of the principals of distribution and dispersion. Referring to FIG. 1, it is seen that a small amount of an additive "A" is introduced on a continuous flow basis to a continuous main product flow "B". The two components then pass through a mixing system. The additive "A" is divided into many small components by the mixing system and the stream exits with the additive distributed across the cross-section of the main flow "B". The typical distance "S" between the concentration centers of the additive is small relative to the main flow diameter "D". Good distribution of additive "A" in stream "B" has been achieved.

The concept of dispersion is shown in FIGS. 2A and 2B. In FIG. 2A, the additive "A" is distributed in the main flow stream "B" material where molecular diffusion between "A" and "B" is virtually zero. The concentration values are either 0% or 100% or, in other words, the intensity "I" of "A" and "B" has a value of either 0% or 100%. In other words, zero dispersion has been achieved. However, in FIG. 2B some degree of molecular diffusion has occurred and the range of the intensity value found in the flow stream as measurements are taken across the conduit is now less than 0% to 100%.

It is obviously a goal in any mixing device to improve distribution and dispersion of component fluid streams. However, this is oftentimes difficult if this goal is attempted by simply adding more mixing elements. The addition of mixing elements often results in pressure drops across the mixing system while such systems tend to increase in length and cost to a point where such parameters prove prohibitive. Furthermore, small filament streams of component "A" can oftentimes tunnel through the mixing structure without further reduction in size.

Current motionless mixing designs use elements having a constant geometry in a given pipe size. In other words, the dimensions of scale of each mixing element relative to the pipe diameter does not change in proceeding through the motionless mixer in the direction of flow. As a result, increasing the number of mixing elements after a certain point has little effect on the mix quality of the output and, yet, as noted previously, additional mixing elements can create unwanted pressure drops across the system and resultant increased system costs. Even if the conduit cross-section were to be reduced in size in an attempt to improve mixing, substantial pressure drops can again result requiring additional pumping and resultant energy costs in carrying out the mixing process.

It is thus an object of the present invention to provide a motionless material mixing apparatus which improves upon the efficiency of mixing while not increasing the cost or pressure drop across the apparatus.

DETAILED DESCRIPTION OF THE DRAWINGS

This and further objects will be more readily perceived when considering the following disclosure and appended drawings wherein.

SUMMARY OF THE INVENTION

The present invention deals with a stationary material mixing apparatus for the mixing of a fluid stream. The apparatus comprises a conduit having a length, a cross-section, a longitudinal axis through the length and a chamber extending longitudinally through the length. The conduit is provided with openings at a first upstream end and second downstream end and is provided with at least two mixing stations located therein along the longitudinal axis.

Each mixing station comprises an array of mixing elements occupying the entire cross-section of the conduit such that all fluid passing from the upstream end to the downstream end must pass through each array of mixing elements. The array of mixing elements at each mixing station is related to mixing elements at other mixing stations in that mixing elements at downstream mixing stations are of a smaller dimension than mixing elements at upstream mixing stations. As such, more mixing elements are contained within each mixing station as mixing stations approach the second downstream end of the conduit.

DESCRIPTION OF THE INVENTION

Figure 3:
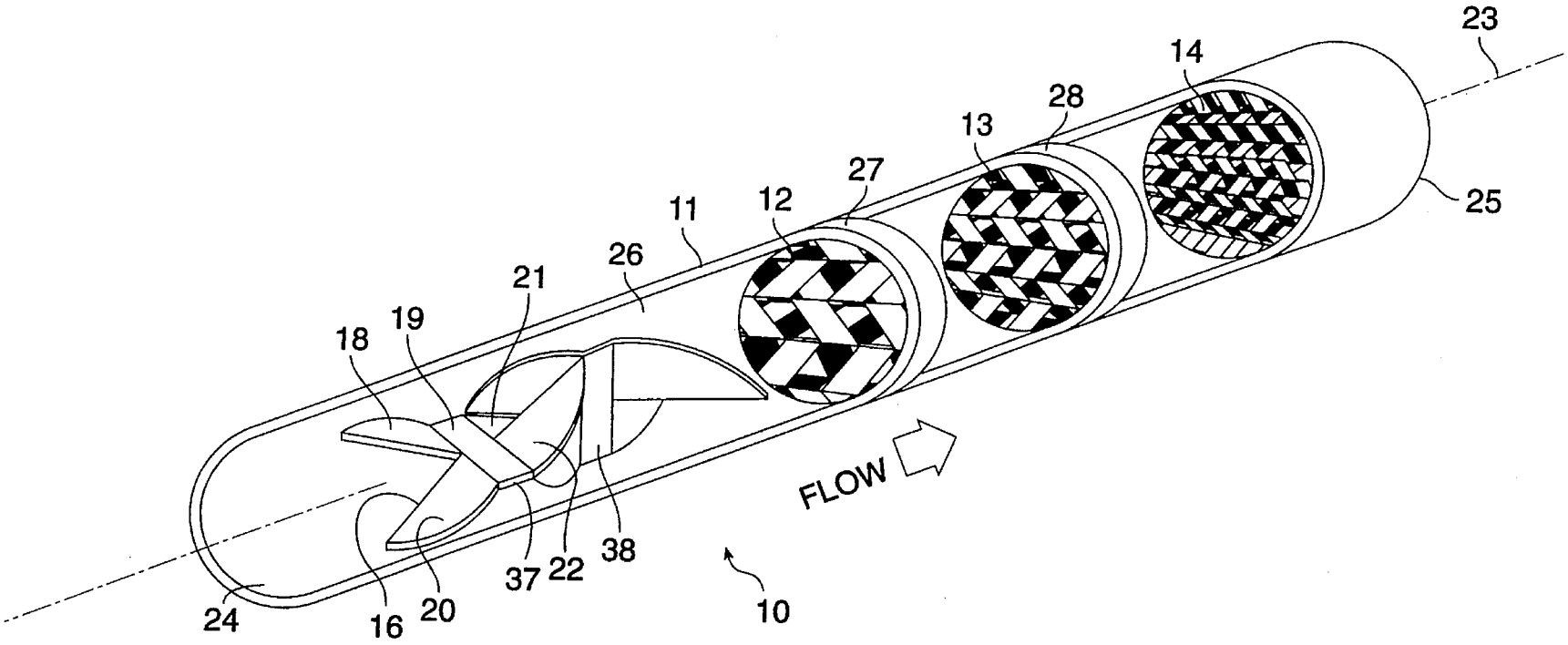
FIG. 3 is an isometric perspective view of the present invention depicting various mixing elements by removing a portion of the external conduit.

The present invention can best be visualized by viewing FIG. 3 in which stationary material mixing apparatus 10 is shown in perspective. In order to visualize the actual mixing elements, conduit 11 is shown in a cutaway fashion. The apparatus is shown having a length, longitudinal axis 23 through said length and a chamber 26 extending longitudinally through said length.

Fluid flow is depicted in passing in the direction of the arrow shown below conduit 11 such that the conduit is provided with a first upstream end 24 and second downstream 25.

In the embodiment shown in FIG. 3, mixing stations 12, 13 and 14 are provided noting that the present invention contemplates at least two mixing stations located within conduit 11 and along longitudinal axis 23. Each mixing station comprises an array of mixing elements which are best visualized in referring to FIGS. 4 and 5.

In again referring to FIG. 3, it is further noted that the array of mixing elements 12, 13 and 14 at each mixing station are related to mixing elements at other mixing stations in that mixing elements at downstream mixing stations are of a smaller dimension than mixing elements at upstream mixing stations so that more mixing elements are contained within each mixing station as mixing stations approach downstream end 25. It is further noted that, preferably, each array of mixing elements 12, 13 and 14 form a plane substantially perpendicular to longitudinal axis 23.

Mixing stations 12, 13 and 14 can comprise a wide variety of mixing element arrays. The term "mixing element" is intended to encompass more than mere screens or perforated plates. Specifically, mixing elements are intended to encompass devices which orient adjacent streams as they pass through such devices from upstream end 24 to downstream end 25. Mere screens or perforated plates do nothing more than temporarily separate a fluid stream into substreams which recombine after the screen or plate has been traversed.

A number of various mixing elements can be employed in fashioning mixing arrays 12, 13 and 14 as long as the basic concept of the present invention is adhered to. That is, it is critical in practicing the present invention that the array of mixing elements at each mixing station be related to mixing elements at other mixing stations in that mixing elements at downstream mixing stations are of a smaller dimension than mixing elements at upstream mixing stations. As such, more mixing elements are contained within each mixing station as mixing stations approach the second downstream end 25 of the device.

Figure 4:
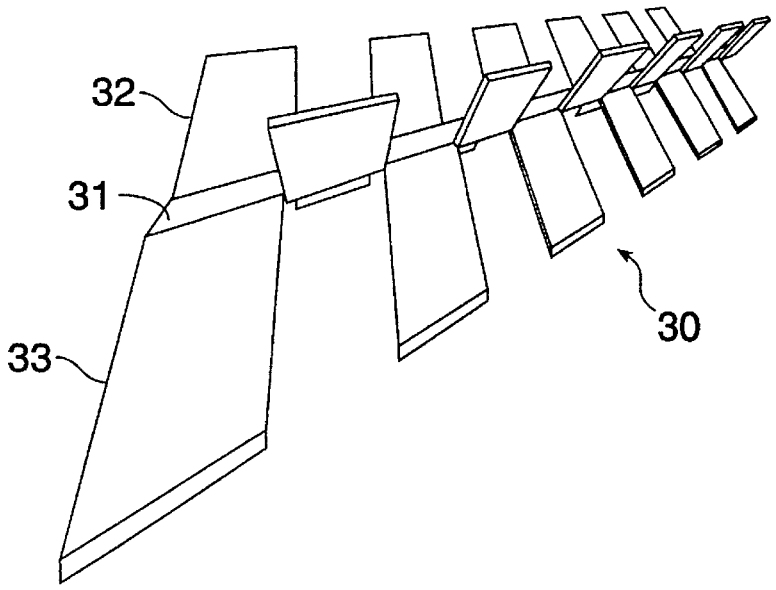
FIG. 4 shows the fabrication of a single row of mixer elements to be contained within the mixer array of the present invention.

A preferred array of mixing elements can be produced from a flat beam of metal as shown in FIG. 4. Single array 30 was configured from a flat rectangular piece of metal such as steel or aluminum where individual "ears" 32 and 33 have been bent to form a single piece of rectangular stock such that central portion 31 is contiguous throughout the single strand array 30.

Figure 5:
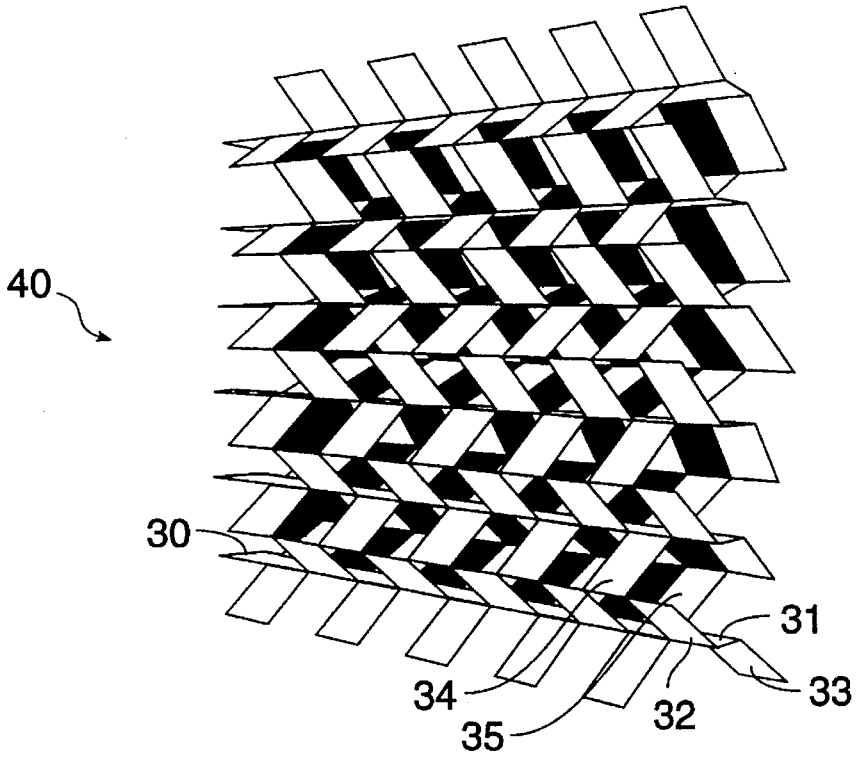
FIG. 5 illustrates the creation of a mixer array by employing a series of parallel rows of mixer elements as shown in FIG. 4.

The single strand array shown in FIG. 4 can be duplicated creating an overall mixing array as shown in FIG. 5. As illustrated, single strand array 30 including ears 32 and 33 and flat contiguous portion 31 is duplicated by providing parallel mixing elements throughout the array. To add strength, individual ears 32 and 34 can be brazed at their point of contact 35. Once this is accomplished, the array can be configured into an appropriate circumferential dimension and placed within housing 27, 28, etc. so that the array completely encompasses the entire cross-section of conduit 11. Although conduit 11 is shown with a substantially circular cross-section, the present invention can be used in other configurations such as ovals, squares and rectangles in accomplishing a suitable mixing function.

The mixing array fabricated from parallel "beams" of rectangular sheeting causes an incoming fluid stream to be broken up into substreams which are reoriented as the streams depart from the mixing array. As noted previously, simple holes or screening does not accomplish this function. In addition, the preferred mixing array of the present invention presents an extremely low pressure drop to the mixing apparatus, certainly much lower than a plate arrangement with a pattern of holes configured therein. Further, the mixing array of the present invention does not tend to accumulate debris from the fluid stream where, by comparison, a solid plate or screen mesh tends to capture debris which can result in fluid contamination and blockage of the conduit.

Figure 6:
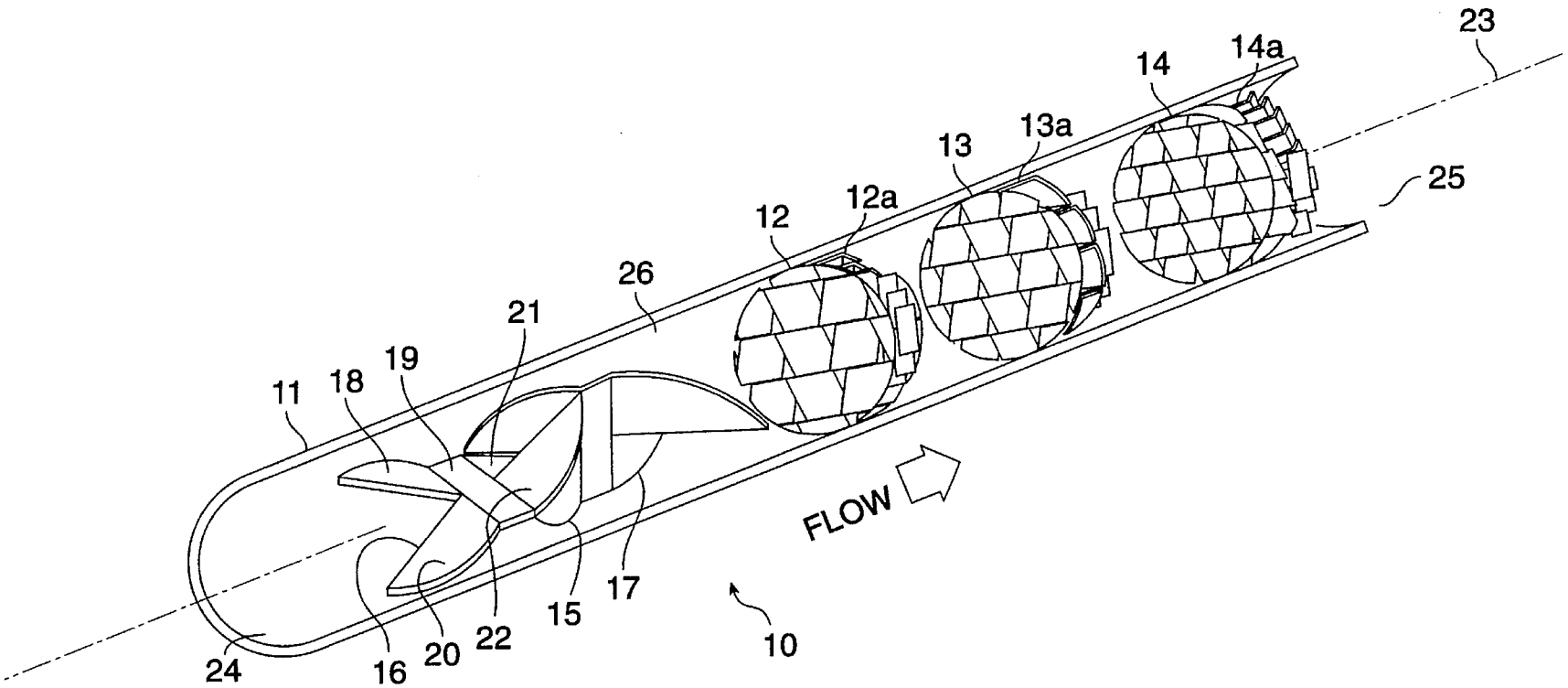
FIG. 6 depicts an isometric perspective view of a preferred embodiment to the present invention where two arrays of mixing elements are combined in a single mixing station.

It is also contemplated that, as a preferred embodiment, at least one mixing station comprises at least two arrays of mixing elements. This can be best visualized when reference is made to FIG. 6 wherein mixer arrays 12, 13 and 14 are employed in conjunction with arrays 12*a*, 13*a* and 14*a*, respectively. Dual arrays of this nature improve the efficiency of mixing. Ideally, when two arrays are used in tandem at any one mixing station, the arrays are rotated approximately 90° from each other to further enhance mixing.

Figure 1:
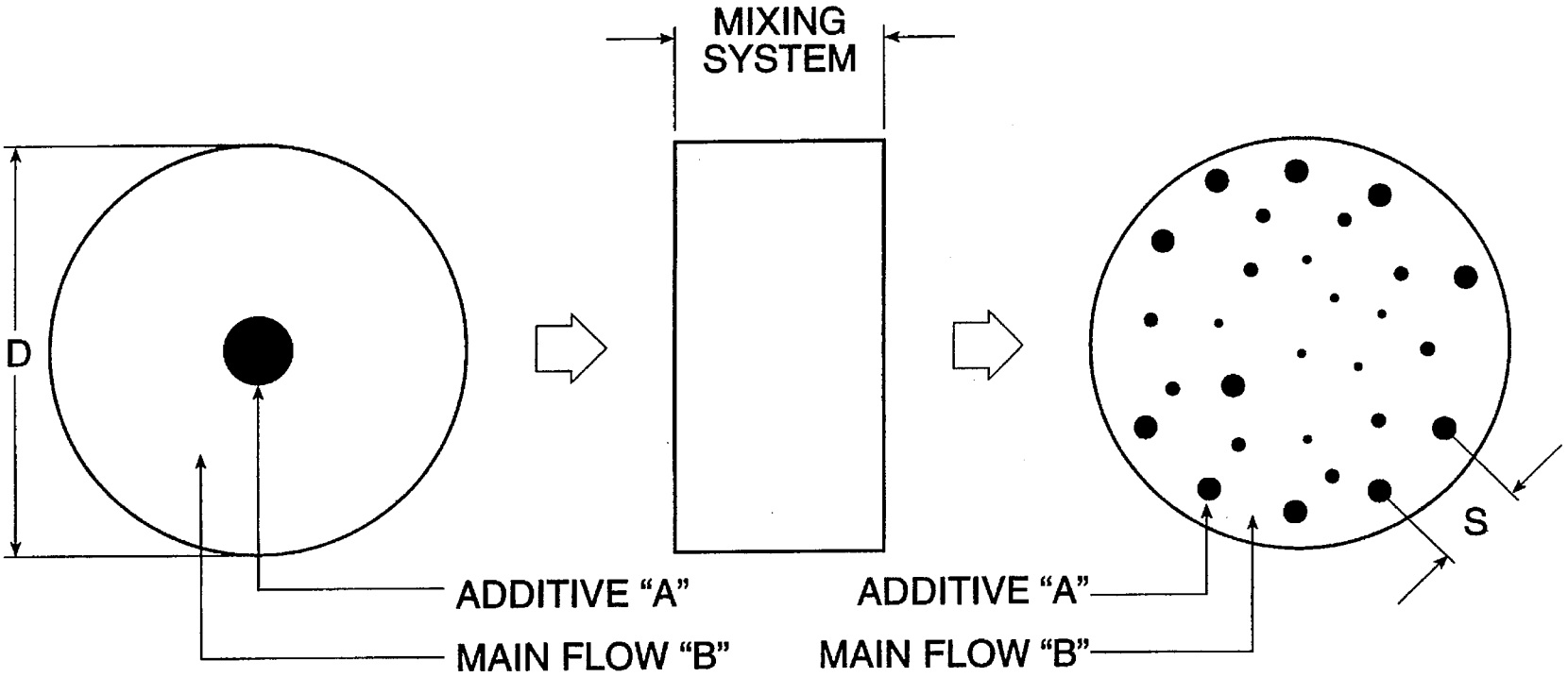
FIG. 1 depicts the cross-section of a typical mixing apparatus and graph illustrating a principal of distribution.
Figure 2:
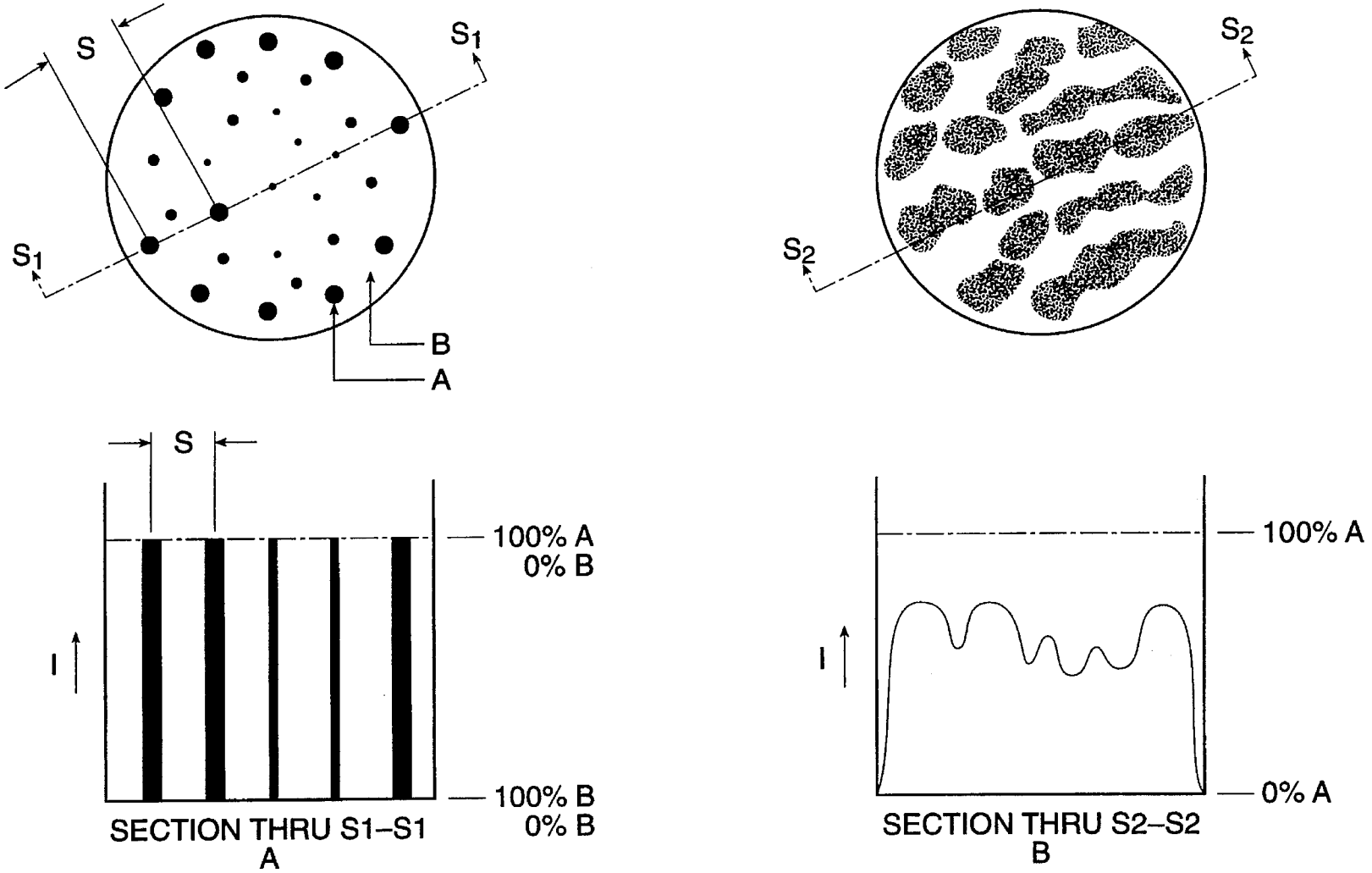
FIG. 2 depicts the cross-section of a typical mixing apparatus and graph illustrating a principal of dispersion.

Mixing arrays 12, 13 and 14 are employed to enhance dispersion between various components of a fluid stream. However, in discussing FIGS. 1 and 2, it was noted that mixing is further enhanced by increasing the distribution of one component in a main fluid stream. In accomplishing this goal, it is advantageous to employ yet further mixing elements at mixing station 16 located within conduit 11 between first upstream end 24 and most upstream mixing station 12.

As noted, mixing station 16 differs from the remaining mixer arrays in enhancing distribution rather than dispersion of component parts of the fluid stream. It has been found ideal to employ more than one mixing element as described and claimed in applicant's U.S. Pat. No. 3,923,288, the disclosure of which is incorporated herein by reference. Each mixing element includes a flat central portion 19 and first and second ears 18 and 20, rounded or otherwise configured at their outside peripheries for a general fit to the wall of conduit 11. A second pair of ears 21 and 22 at the opposite side of flat portion 19 are bent downward and upward respectively. The outside peripheral edges of ears 21 and 22 are also rounded or otherwise configured for a general fit to the wall of conduit 11.

It is well recognized that virtually all motionless mixers produce a pressure drop. However, by changing the scale of the mixing structure through the mixing system a user can more effectively "spend" its pressure drop budget. A course scale of mixing structure at the mixing inlet, for example, at mixing station 16, produces a low pressure drop with little dispersion. The main job of the initial mixing elements is to distribute the various components in the fluid stream. At the mixer exit where the scale of the structure is finer, a higher pressure drop per mixing element is established with very little distribution but much higher dispersion. For example, if the scale is ten times finer, the pressure drop is ten times higher. However, the number of divisions produced in that mixing station is one hundred times higher. This can be seen from the following:

$$\text{Delta P}=(5.3\times10^{-5}Q\mu D^3)\times D/I \text{ psi}$$

wherein

Q=flow rate in gpm

μ=viscosity in cp

D=pipe inside diameter

Figure 7:
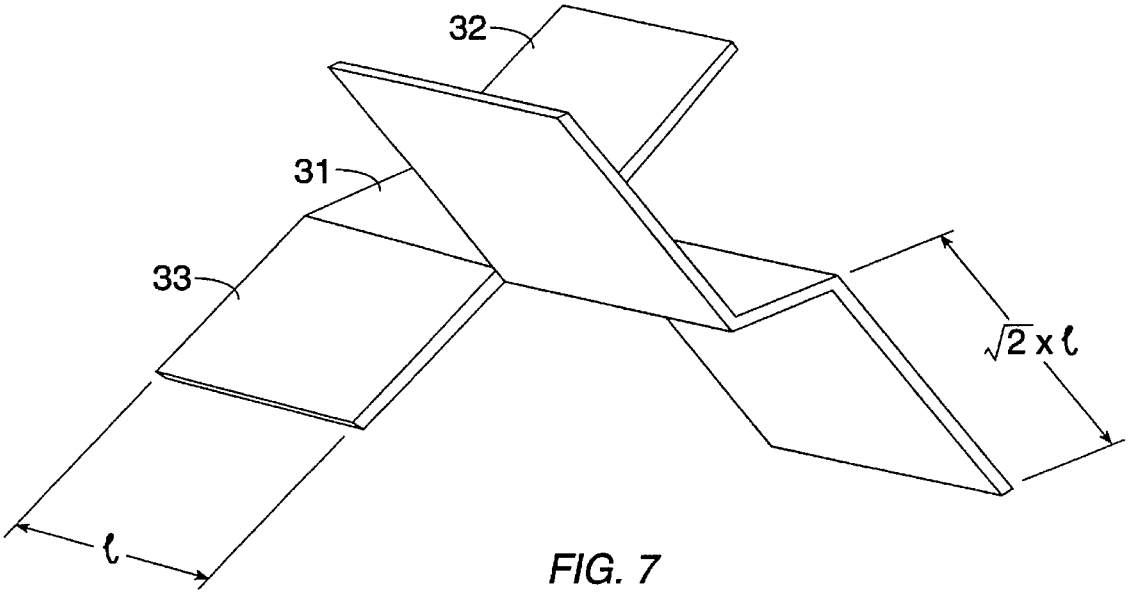
FIG. 7 depicts an oblique perspective view of a section of mixer elements typically found at a single mixing station pursuant to the present invention.

I=element "ear" dimension shown in FIG. 7

As noted, in reference to FIG. 7, a typical array of mixing elements includes continuous flat central portion 31 and ears 32 and 33. Regarding the above-recited pressure drop formula, the width of a typical "ear" with the $\sqrt{2}\times I$ being its length.

The term D/I is used in referring to the scale of the structure. As such, when D/I is low, large scale elements are employed and the pressure drop is low. Conversely, when D/I is high, the elements are of a small scale and the pressure drop is high. As such, as a generality, the following table governs the design criteria for practicing the present invention:

| Scale | Coarse | Medium | Fine |
|---|---|---|---|
| Delta P | Low | Medium | High |
| Distribution | Good | Fair | Poor |
| Dispersion | Poor | Fair | Good |

It is further recognized that the above-recited equation applies to fluids and laminar flow. The same basic design criteria will apply to any structure where the pressure drop is calculated by:

$$\text{Delta P}=(KQ\mu/D^3)\times(\text{scale})$$

where K is a constant usually determined experimentally

It is further recognized that as a finer or smaller scale structure is employed, the length of the mixing element becomes proportionally shorter. This can be an important factor is a user wishes to minimize the residence time of some time/temperature sensitive material.

Elements 37 and 38 may be formed from a single flat sheet by a punch press, for example. However, they can also be fabricated in any number of ways, for example, by providing a plurality of pieces brazed, soldered, welded or otherwise fastened together. Mixing elements 37 and 38 provide abutting, self-nesting element fit within chamber 11 whereby these adjacent elements are configured as mirror images of one another. Each element is provided with a length along longitudinal axis 23. Adjacent elements 37 and 38 tend to axially overlap defining mixing matrices inducing both counter-rotating angular velocities relative to longitudinal axis 23 and simultaneous inward and outward radial velocities relative to said longitudinal axis on materials moving through said mixing matrices. The axially non-overlapping lengths of said elements along the length of the longitudinal axis define drift spaces for the recombination of materials subsequent to movement through the mixing matrices. As such, station 16 upstream of first mixing matrix 12 acts as an efficient means of enhancing distribution of fluid components passing therethrough. As such, dispersion created stations 12, 13 and 14 are efficient in enhancing dispersion of the same components resulting in an overall efficient mixing operation.

In view of the foregoing, modifications to the disclosed embodiments within the spirit of the invention will be apparent to those of ordinary skill in the art. The scope of the invention is therefore to be limited only by the appended claims.

I claim:

1. A stationary material mixing apparatus for the mixing of a fluid stream comprising a conduit having a length, cross-section, a longitudinal axis through said length and a chamber extending longitudinally through said length opening at first upstream and second downstream ends of said conduit and including said longitudinal axis, at least two mixing stations located within said conduit and along said longitudinal axis, each mixing station comprising an array of mixing elements occupying the entire cross-section of said conduit such that all fluid passing from said upstream end to said downstream end must pass through each array of mixing elements, and wherein the array of mixing elements at each mixing station being related to mixing elements at other mixing stations and that mixing elements at downstream mixing stations are of a smaller dimension than mixing elements at upstream mixing stations so that more mixing elements are contained within each mixing station as mixing stations approach the second downstream end and wherein said array of mixing elements comprise a series of parallel mixing elements, each element comprising a flat rectangular central portion having first and second ears emanating from said central portion bent upwards and downwards relative to the plane of said central portion.

2. The stationary material mixing apparatus of claim 1 wherein each series of parallel mixing elements are fabricated from a single piece of rectangular stock such that each central portion of each mixing element within a series is contiguous with the remaining central portions of mixing elements within the series.

3. A stationary material mixing apparatus for the mixing of a fluid stream comprising a conduit having a length, cross-section, a longitudinal axis through said length and a chamber extending longitudinally through said length opening at first upstream and second downstream ends of said conduit and including said longitudinal axis, at least two mixing stations located within said conduit and along said longitudinal axis, each mixing station comprising an array of mixing elements occupying the entire cross-section of said conduit such that all fluid passing from said upstream end to said downstream end must pass through each array of mixing elements, and wherein the array of mixing elements at each mixing station being related to mixing elements at other mixing stations and that mixing elements at downstream mixing stations are of a smaller dimension than mixing elements at upstream mixing stations so that more mixing elements are contained within each mixing station as mixing stations approach the second downstream end and wherein said array of mixing elements comprise a series of parallel mixing elements, each element comprising a flat rectangular central portion having first and second ears emanating from said central portion bent upwards and downwards relative to the plane of said central portion wherein said at least two arrays of mixing elements located at said mixing station are rotated approximately 90° from each adjacent array.

4. The stationary material mixing apparatus for the mixing of a fluid stream comprising a conduit having a length, longitudinal axis through said length, a cross-section and a chamber extending longitudinally through said length opening at first upstream and second downstream ends of said conduit and including said longitudinal axis, at least two mixing stations located within said conduit and along said longitudinal axis, each mixing station comprising an array of mixing elements occupying the entire cross-section of said conduit such that all fluid passing from said upstream end to said downstream end must pass through each array of mixing elements wherein the array of mixing elements at each stations being related to mixing elements at other mixing stations in that mixing elements at downstream mixing stations are of a smaller dimension than mixing elements at upstream mixing stations so that more mixing elements are contained within each mixing station as mixing stations approach the second downstream end and at least one mixing element further located within said conduit between said first upstream end and most upstream mixing station and wherein said array of mixing elements comprise a series of parallel mixing elements, each element comprising a flat rectangular central portion having first and second ears emanating from said central portion bent upwards and downwards relative to the plane of said central portion.

5. The stationary material mixing apparatus of claim 4 wherein each array of mixing elements form a plane substantially perpendicular to said longitudinal axis.

6. The stationary material mixing apparatus of claim 4 wherein at least one mixing station comprises at least two arrays of mixing elements.

7. The stationary material mixing apparatus of claim 4 wherein each series of parallel mixing elements are fabricated from a single piece of rectangular stock such that each central portion of each mixing element within a series is contiguous with the remaining central portions of mixing elements within the series.

8. The stationary material mixing apparatus of claim 4 wherein said at least two arrays of mixing elements located at said mixing station are rotated approximately 90° from each adjacent array.

9. A stationary material mixing apparatus for the mixing of a fluid stream comprising a conduit having a length, longitudinal axis through said length, a cross-section and a chamber extending longitudinally through said length opening at first upstream and second downstream ends of said conduit and including said longitudinal axis, at least two mixing stations located within said conduit and along said longitudinal axis, each mixing station comprising an array of mixing elements occupying the entire cross-section of said conduit such that all fluid passing from said upstream end to said downstream end must pass through each array of mixing elements wherein the array of mixing elements at each stations being related to mixing elements at other mixing stations in that mixing elements at downstream mixing stations are of a smaller dimension than mixing elements at upstream mixing stations so that more mixing elements are contained within each mixing station as mixing stations approach the second downstream end and at least one mixing element further located within said conduit between said first upstream end and most upstream mixing station and wherein said array of mixing elements comprise a series of parallel mixing elements, each element comprising a flat rectangular central portion having first and second ears emanating from said central portion bent upwards and downwards relative to the plane of said central portion, wherein said at least one mixing element comprises a plurality of abutting, self-nested elements fit within said chamber, adjacent elements being configured as mirror images of one another, each element having lengths along the longitudinal axis where adjacent elements axially overlap defining mixing matrices inducing both counter-rotating angular velocities relative to said longitudinal axis and simultaneous inward and outward radial velocities relative to said longitudinal axis on materials moving through said mixing matrices, each element having a length along the longitudinal axis where said elements do not axially overlap, the axially overlapping lengths of said elements along the length of the longitudinal axis defining draft spaces for the recombination of said materials subsequent to movement through the mixing matrices.

10. A stationary material mixing apparatus for the mixing of a fluid stream comprising a conduit having a length, a cross-section, a longitudinal axis through said length and a chamber extending longitudinally through said length opening at first upstream and second downstream ends of said conduit and including said longitudinal axis, at least two mixing stations located within said conduit and along said longitudinal axis each mixing station comprising an array of mixing elements occupying the entire cross-section of said conduit such that all fluid passing from said upstream end to said downstream end must pass through each array of mixing elements, and wherein at least one mixing element is provided within said conduit at a location between said first upstream end and most upstream mixing station and wherein said more than one mixing element comprises a plurality of abutting, self-nesting elements fit within said chamber, adjacent elements being configured as mirror images of one another, each element having lengths along the longitudinal axis where adjacent elements axially overlap defining mixing matrices inducing both counter-rotating angular velocities relative to said longitudinal axis and simultaneous inward and outward radial velocities relative to said longitudinal axis on materials moving through said mixing matrices, each element having a length along the longitudinal axis where said elements do not axially overlap the axially non-overlapping lengths of said elements along the length of the longitudinal axis defining draft spaces for the recombination of said materials subsequent to movement through the mixing matrices.

* * * * *